US009949515B2

(12) United States Patent
Wilkins et al.

(10) Patent No.: US 9,949,515 B2
(45) Date of Patent: Apr. 24, 2018

(54) SUPPORT DEVICE AND METHOD OF USE THEREOF

(71) Applicants: Catherine Wilkins, Landenberg, PA (US); Elizabeth Tucker, West Chester, PA (US)

(72) Inventors: Catherine Wilkins, Landenberg, PA (US); Elizabeth Tucker, West Chester, PA (US)

(73) Assignee: Swittie Girls, LLC, Landenberg, PA (US)

( * ) Notice: Subject to any disclaimer, the term of this patent is extended or adjusted under 35 U.S.C. 154(b) by 215 days.

(21) Appl. No.: 14/870,448

(22) Filed: Sep. 30, 2015

(65) Prior Publication Data

US 2016/0088881 A1 Mar. 31, 2016

Related U.S. Application Data

(60) Provisional application No. 62/057,317, filed on Sep. 30, 2014.

(51) Int. Cl.

| | |
|---|---|
| ***A41D 7/00*** | (2006.01) |
| ***A41C 3/00*** | (2006.01) |
| ***A41F 15/00*** | (2006.01) |
| ***A41D 1/22*** | (2018.01) |
| *A47K 10/02* | (2006.01) |

(52) U.S. Cl.

CPC ..... *A41D 7/008* (2013.01); *A41C 3/0028* (2013.01); *A41D 1/22* (2013.01); *A41F 15/002* (2013.01); *A41F 15/00* (2013.01); *A47K 10/02* (2013.01)

(58) Field of Classification Search

CPC ..... A41D 7/008; A41D 15/04; A41D 27/00; A47K 10/02

USPC ..... 2/49.1, 69, 69.5, 207; 5/417; 450/30, 450/31, 59, 60, 62, 64, 85–87

See application file for complete search history.

(56) References Cited

U.S. PATENT DOCUMENTS

| | | | | |
|---|---|---|---|---|
| 2,428,175 | A * | 9/1947 | Norton | A41C 3/08 2/67 |
| 5,245,707 | A | 9/1993 | Green | |
| 5,603,653 | A | 2/1997 | Hartman | |
| 5,756,177 | A * | 5/1998 | Cheong | A41D 7/006 2/69 |
| 6,113,460 | A | 9/2000 | McKeown | |
| 6,203,399 | B1 | 3/2001 | Hackney | |
| 6,406,353 | B1 | 6/2002 | Harper | |
| 7,056,187 | B2 | 6/2006 | Cassity | |
| 7,077,719 | B2 | 7/2006 | Shiekman | |
| 8,075,367 | B2 | 12/2011 | Taylor | |
| 8,690,635 | B1 | 4/2014 | Calvert | |

(Continued)

FOREIGN PATENT DOCUMENTS

WO WO 2000/007470 2/2000

OTHER PUBLICATIONS

Breezy Halter Dress, available at http://allwomenstalk.com/top-8-must-have-beach-dresses/6/ (2015).

*Primary Examiner* — Katherine Moran

(74) *Attorney, Agent, or Firm* — McCarter & English, LLP

(57) ABSTRACT

Exemplary embodiments are directed to support devices to be worn by a user. The support devices include an elongated strip configured to wrap underneath respective breasts of a user and around the neck of a user to provide support to the breasts of the user.

17 Claims, 11 Drawing Sheets

(56) References Cited

U.S. PATENT DOCUMENTS

| | | | | |
|---|---|---|---|---|
| 2005/0044606 | A1 | 3/2005 | Flanagan-Frazier | |
| 2009/0025119 | A1* | 1/2009 | Nespor | A41D 7/008 2/84 |
| 2009/0083895 | A1 | 4/2009 | Pellegrini et al. | |
| 2009/0106873 | A1 | 4/2009 | Whiteside | |
| 2011/0314584 | A1 | 12/2011 | Wang | |
| 2014/0157478 | A1* | 6/2014 | Van De Velde | A41D 15/00 2/69 |
| 2015/0305411 | A1* | 10/2015 | Caco | A41D 1/22 2/69 |
| 2016/0007664 | A1* | 1/2016 | Garriga | A41D 7/008 2/69 |
| 2016/0135518 | A1* | 5/2016 | Scott | A41D 7/008 2/69 |

* cited by examiner

SUPPORT DEVICE AND METHOD OF USE THEREOF

CROSS-REFERENCE TO RELATED APPLICATIONS

This application claims the benefit of U.S. Provisional Application No. 62/057,317, which was filed on Sep. 30, 2014. The entire content of the foregoing provisional patent application is incorporated herein by reference.

TECHNICAL FIELD

The present disclosure relates to support devices and, in particular, to support devices that provide support to the breasts of the user.

BACKGROUND

After taking a shower or bath, or during activities in a spa, it may be desirable to wrap a towel around one's upper body to prevent dripping water or to begin the drying process. Towels are generally wrapped at an area above the breasts and edges of the towel are layered to minimize slippage of the towel during wear.

However, friction between the layers of the towel is generally insufficient to maintain the towel around the user, especially during movement of the user, thereby resulting in the towel unwrapping and coming off. This can be frustrating when the user is attempting to complete certain tasks prior to fully drying off. In addition, wrapping a towel around the breasts typically presses the breasts against the body, resulting in perspiration beneath the breasts.

Thus, a need exists for support devices which can be wrapped around the user in a secure manner, provide support to the breasts and absorb perspiration beneath the breasts. These and other needs are addressed by the support devices of the present disclosure.

SUMMARY

In accordance with embodiments of the present disclosure, exemplary towels to be worn by a user are provided. One feature of the invention is that the towels include a main body portion and a neck support. Another feature of the invention is that the neck support includes first and second ends which provide support to breasts of the user.

In accordance with embodiments of the present disclosure, exemplary towels to be worn by a user are provided. One feature of the invention is that the towels include a main body portion and a support device secured to the main body portion. Another feature of the invention is that the support device can include one or more elongated strips that include first and second portions configured to wrap underneath breasts of the user. One object of the invention is that the one or more elongated strips can form a neck support configured to wrap around a neck of the user.

In accordance with embodiments of the present disclosure, exemplary towels to be worn by a user are provided. One feature of the invention is that the towels include a main body portion and a support device secured to the main body portion. Another feature of the invention is that the support device can include an elongated strip that includes first and second portions configured to wrap underneath breasts of the user. Another feature of the invention is that the support device can include first and second ends of the elongated strip crisscrossing at a front point of the main body portion.

One object of the invention is that the elongated strip can form a neck support configured to wrap around a neck of the user.

In accordance with embodiments of the present disclosure, exemplary support devices to be worn by a user are provided. One feature of the invention is that the support device includes an elongated strip including first and second opposing ends. Another feature of the invention is that the support device further includes a central portion at the elongated strip. Another feature of the invention is that the support device can include complementary attachment mechanisms attached to the first and second opposing ends of the elongated strip. One object of the invention is that the central portion of the elongated strip can be configured to wrap around a back of the use. Another object of the invention is that the elongated strip can be configured to crisscross between breasts of the user. Another object of the invention is that the first and second opposing ends can be configured to wrap around a neck of the user. Another object of the invention is that the complementary attachment mechanisms can be configured to detachably secure relative to each other to maintain the first and second opposing ends secured relative to each other. Another object of the invention is that the first and second portions of the elongated strip can be configured to wrap beneath respective breasts of the user.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed support devices, reference is made to the accompanying figures, wherein.

DESCRIPTION OF EXEMPLARY EMBODIMENTS

Figure 1:
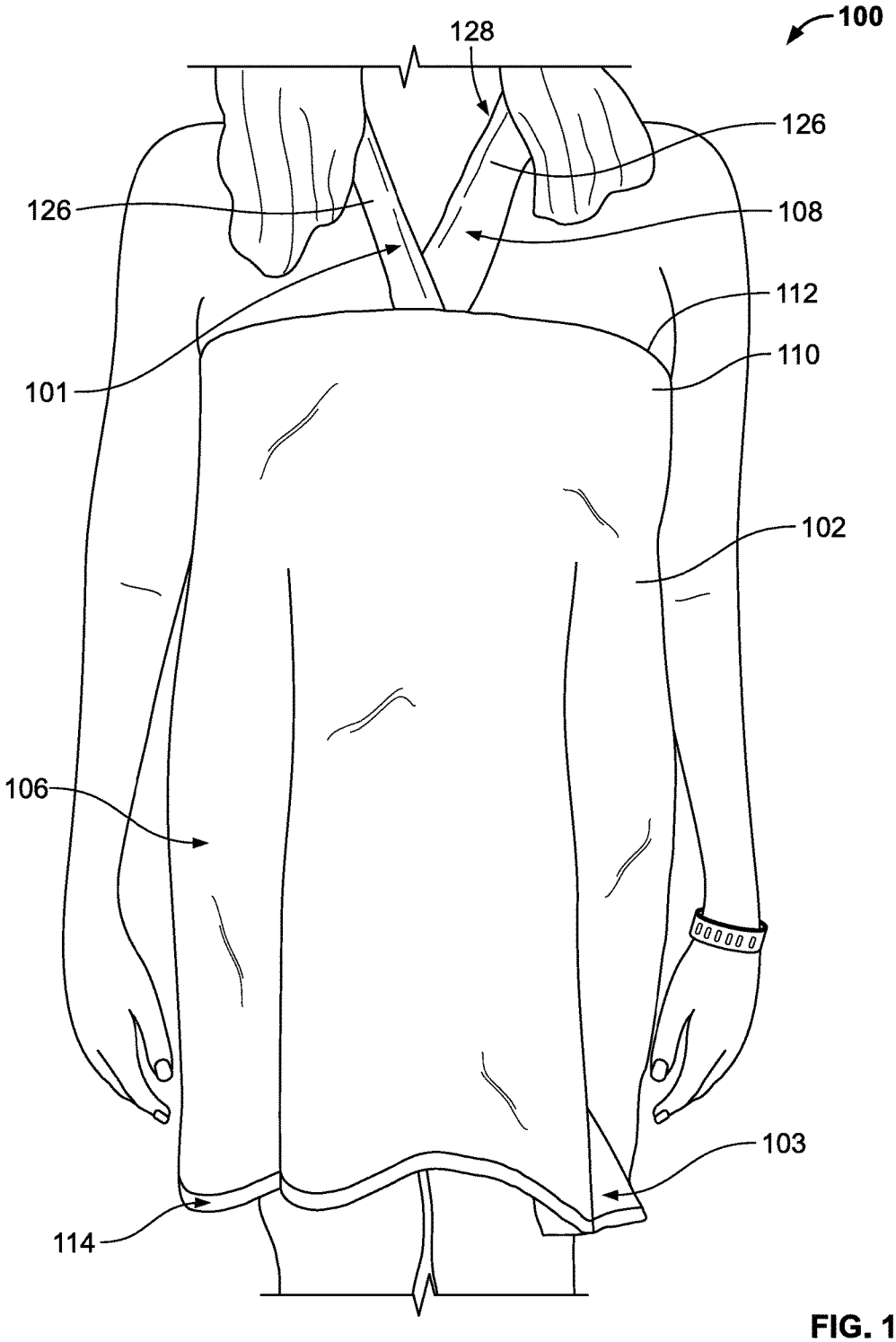
FIG. 1 shows a front view of an exemplary towel including a support device on a user according to the present disclosure.

In accordance with embodiments of the present disclosure, exemplary towels to be worn by a user are provided. The towels include a main body portion and a neck support. The neck support includes first and second ends which provide support to breasts of the user.

The main body portion can be configured and dimensioned to cover an upper body and waist of the user. The main body portion can include an upper edge and a lower edge. In some embodiments, the upper edge includes an elastic band along at least a portion of a perimeter of the upper edge.

The neck support defines an elongated material with the first and second ends on opposing sides relative to each other. The first and second ends can be secured in a semicircular manner on an inner surface of the main body portion. The first and second ends can crisscross at a point along the upper edge of the main body portion. A top portion of the neck support can form a loop configured to be positioned around a neck of the user. The exemplary towels can be securely worn by a user and provide support to the breasts of the user while absorbing perspiration between the breasts and the body of the user.

In accordance with embodiments of the present disclosure, exemplary towels to be worn by a user are provided that include a main body portion and a support device secured to the main body portion. The support device can include one or more elongated strips that include first and second portions configured to wrap underneath breasts of the user. The one or more elongated strips can form a neck support configured to wrap around a neck of the user.

The main body portion can be configured and dimensioned to cover an upper body and waist of the user. The main body portion can include a top edge and a bottom edge. In some embodiments, the top edge can include an elastic band along at least a portion of a perimeter of the top edge. The neck support can include first and second ends on opposing sides relative to each other. The first and second ends can include complementary attachment mechanisms for detachably securing first and second ends relative to each other. The complementary attachment mechanisms allow for adjustment of tension in the neck support.

The first and second portions of the elongated strips can be secured in a semicircular manner on an inner surface of the main body portion. The first and second portions can crisscross at a point along a top edge of the main body portion. In some embodiments, the towel can include a securing element mounted to an inner surface of the top edge of the main body portion. The first and second portions can pass through an opening of the securing element.

The neck support can form a loop configured to be positioned around the neck of the user. In some embodiments, the first and second portions can extend to respective lateral points of the main body portion. In some embodiments, the first and second portions can extend to a rear side of the main body portion and connect at a central connecting portion at the rear side of the main body portion.

In accordance with embodiments of the present disclosure, exemplary towels to be worn by a user are provided that include a main body portion and a support device secured to the main body portion. The support device can include an elongated strip that includes first and second portions configured to wrap underneath breasts of the user. The support device can include first and second ends of the elongated strip crisscrossing at a front point of the main body portion. The elongated strip can form a neck support configured to wrap around a neck of the user.

In some embodiments, the elongated strip can extend around a rear side of the main body portion and can be secured to a central connecting portion at the rear side of the main body portion. In some embodiments, a top edge of the main body portion can include an elastic band along at least a portion of a perimeter of the top edge. The neck support can include first and second ends of the elongated strip on opposing sides relative to each other. The first and second ends can include complementary attachment mechanisms for detachably securing the first and second ends relative to each other.

In accordance with embodiments of the present disclosure, exemplary support devices to be worn by a user are provided. The support device includes an elongated strip including first and second opposing ends. The support device further includes a central portion at the elongated strip. The support device can include complementary attachment mechanisms attached to the first and second opposing ends of the elongated strip. The central portion of the elongated strip can be configured to wrap around a back of the user. The elongated strip can be configured to crisscross between breasts of the user. The first and second opposing ends can be configured to wrap around a neck of the user. The complementary attachment mechanisms can be configured to detachably secure relative to each other to maintain the first and second opposing ends secured relative to each other. The first and second portions of the elongated strip can be configured to wrap beneath respective breasts of the user.

The exemplary towels and support devices advantageously cover the upper body of the user and provide support to the breasts of the user, while simultaneously absorbing perspiration formed between the breasts and body of the user. In particular, rather than merely providing a support for a garment or providing lift to the breasts, the exemplary support devices are secured to an inner surface of the towel to fit underneath the breasts of the user and, in particular, between the breasts and the body of the user. Thus, the support devices maintain the position of the towel on the body of the user and reduce contact between the breasts and the body of the user to prevent or reduce collection of perspiration underneath the breasts.

Figure 2:
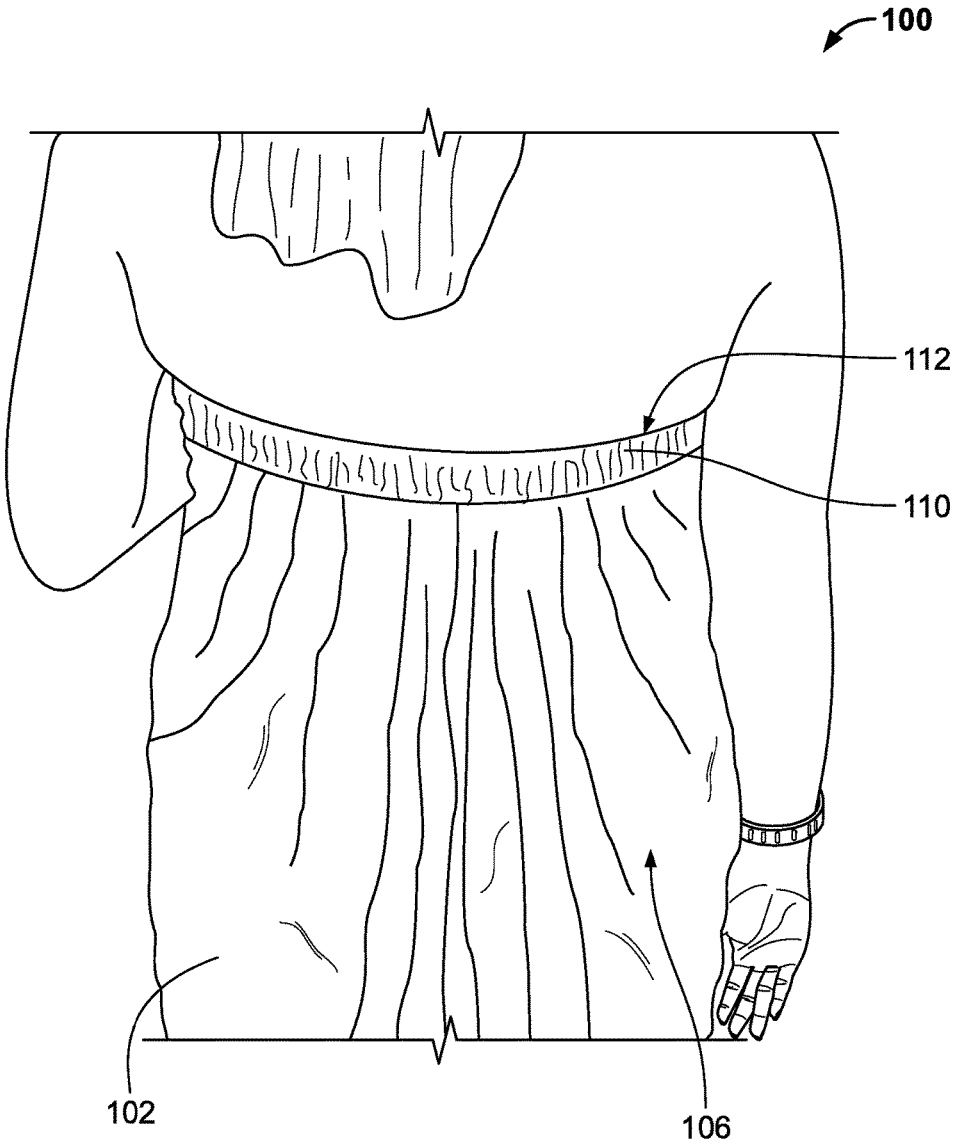
FIG. 2 shows a rear view of the exemplary towel of FIG. 1.
Figure 3:
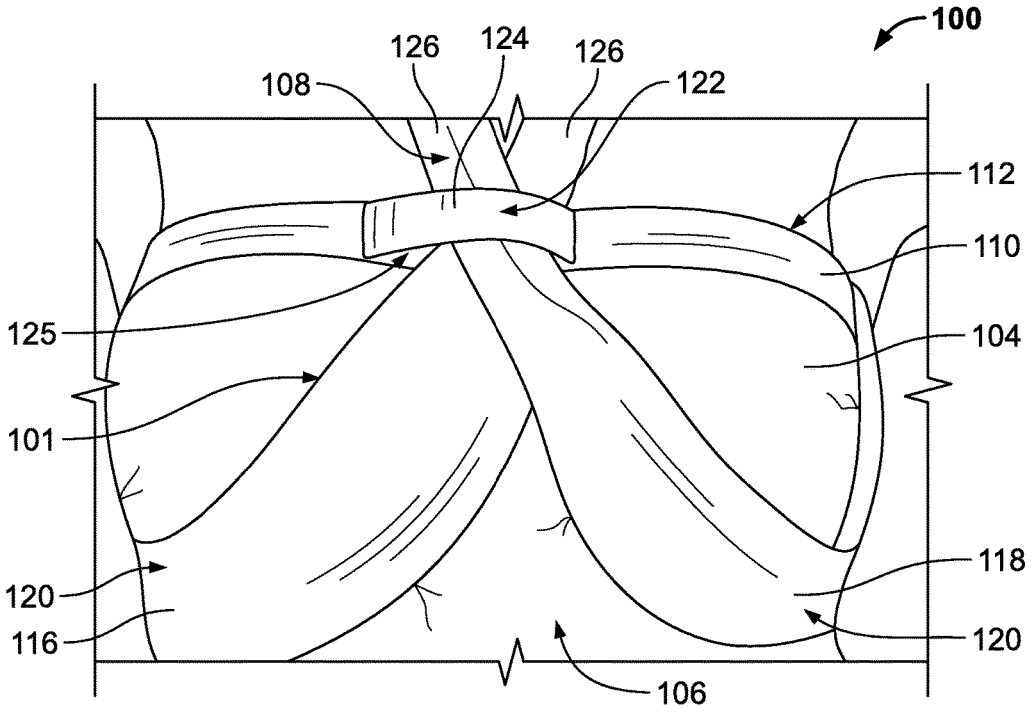
FIG. 3 shows a detailed, front view of the exemplary towel of FIG. 1 inside out to illustrate the inner surface structure of an exemplary support device.
Figure 4:
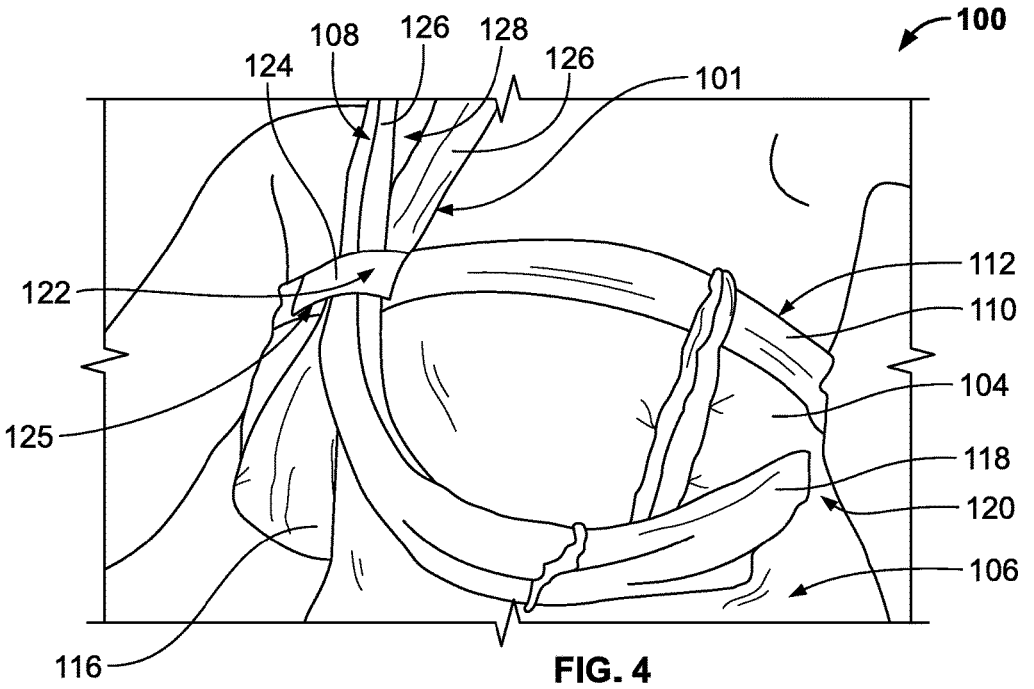
FIG. 4 shows a detailed, perspective view of the exemplary towel of FIG. 1 inside out to illustrate the inner surface structure of an exemplary support device.
Figure 5:
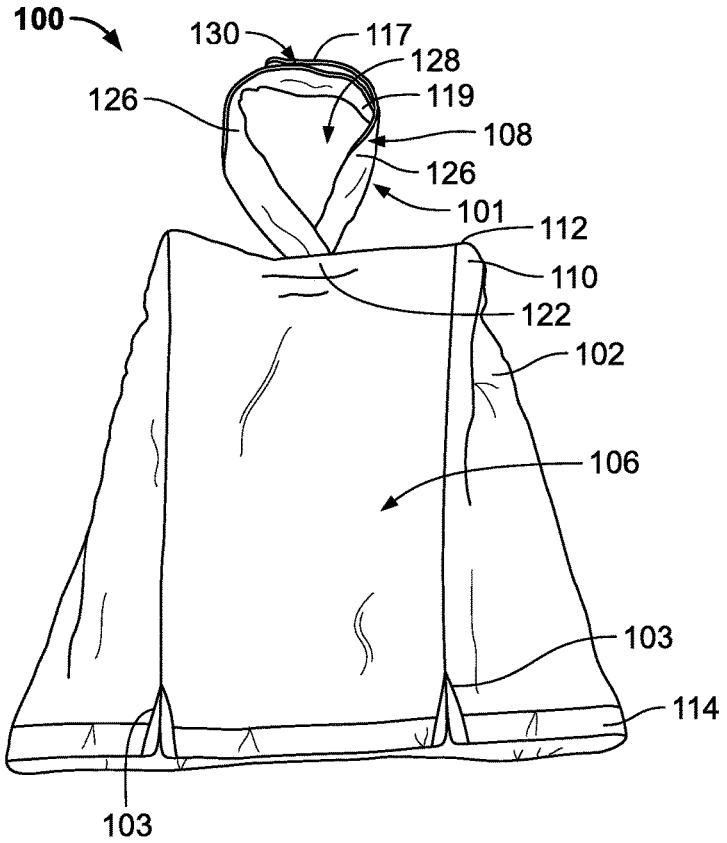
FIG. 5 shows a front view of the exemplary towel of FIG. 1.
Figure 6:
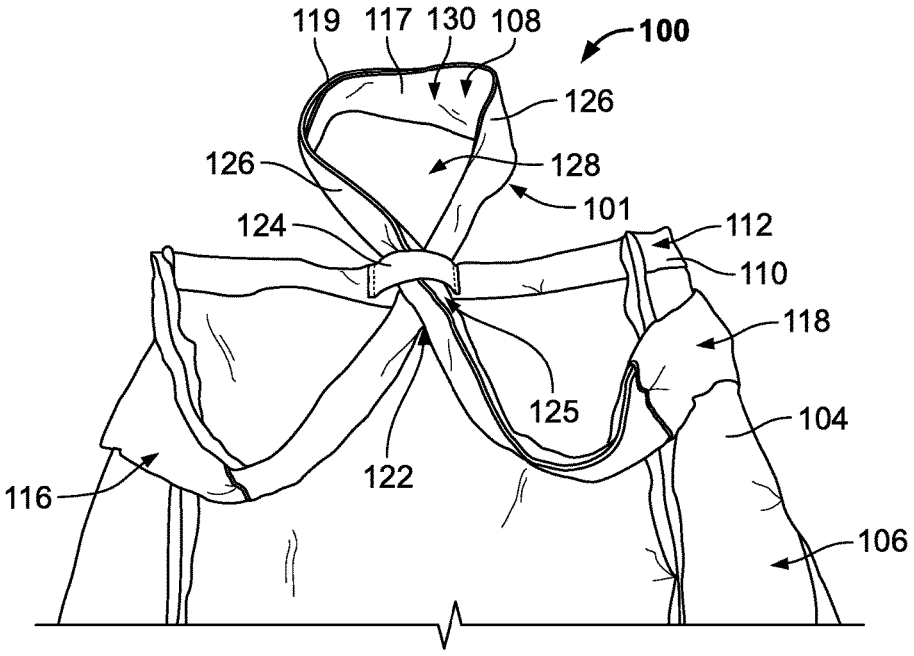
FIG. 6 shows a detailed, front view of the exemplary towel of FIG. 1 inside out to illustrate the inner surface structure of an exemplary support device.
Figure 7:
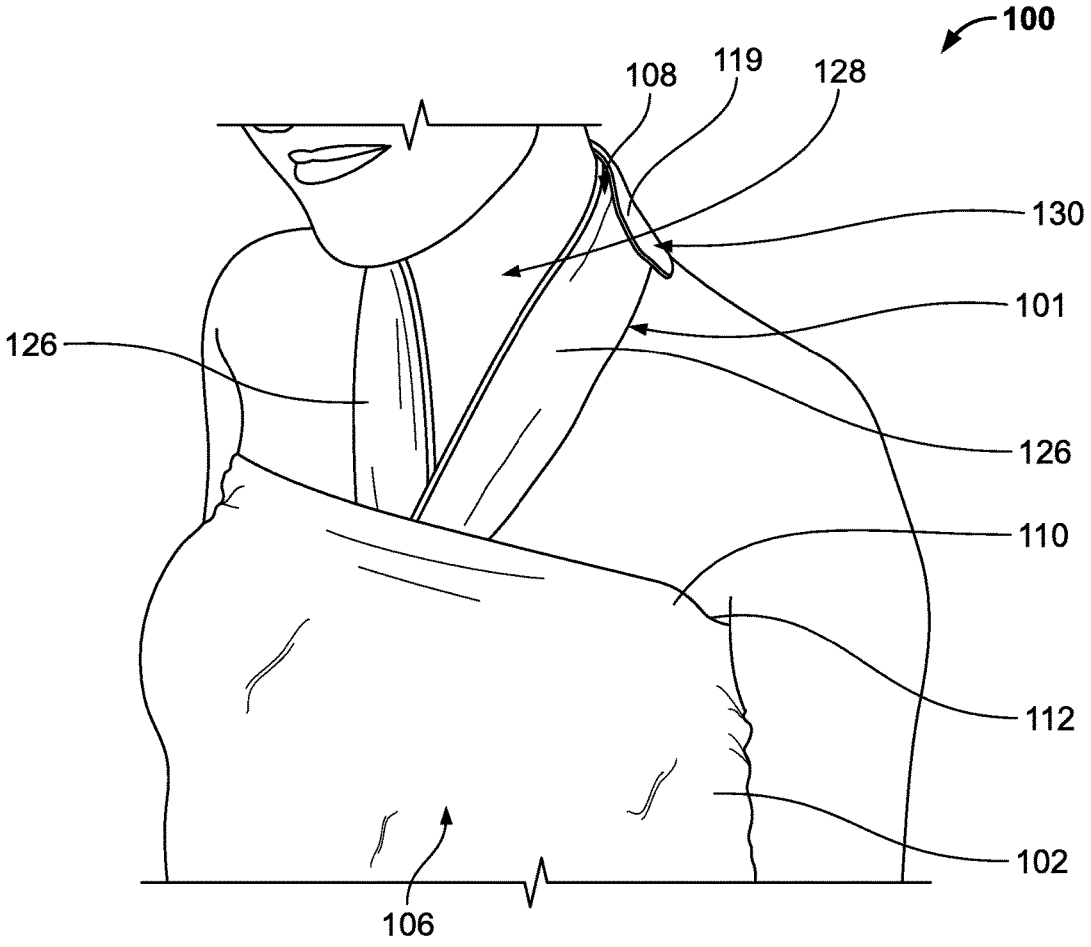
FIG. 7 shows a perspective view of the exemplary towel of FIG. 1 on a user.
Figure 8:
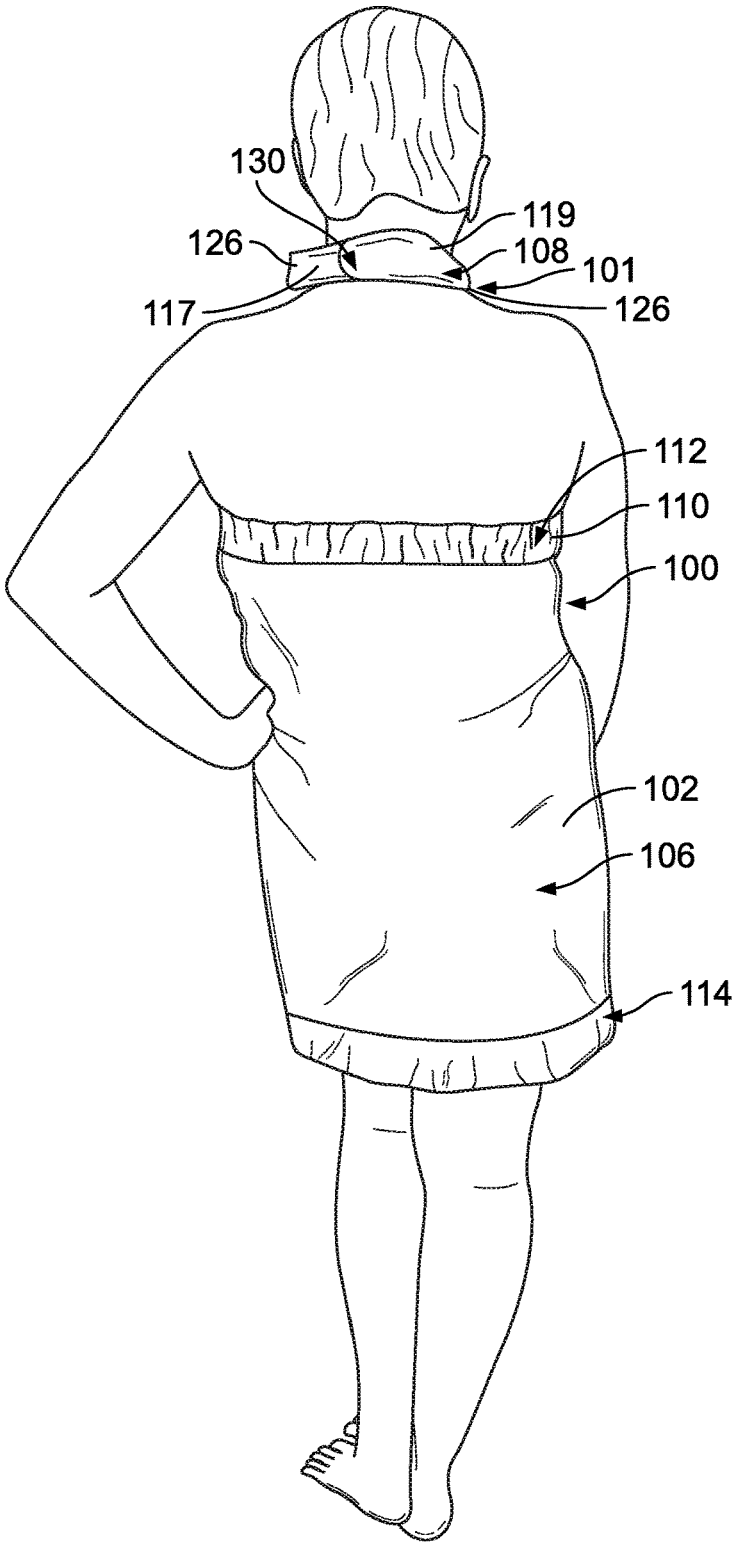
FIG. 8 shows a rear view of the exemplary towel of FIG. 1 on a user.

With reference to FIGS. 1-8, views of an exemplary towel 100 are provided. The exemplary towel 100 includes a support device 101 configured and dimensioned to provide support to the breasts of a user and simultaneously absorb perspiration between the breasts and body of the user. FIGS. 1 and 2 show front and rear views, respectively, of the towel 100 on a user, FIGS. 3 and 4 show views of the towel 100 inside out on the user to illustrate the inner surface structure of a support device of the towel 100, FIG. 5 shows a front view of the towel 100, FIG. 6 shows a front view of the towel 100 inside out, and FIGS. 7 and 8 show perspective and rear views, respectively, of the towel 100 on a user.

The towel 100 includes an outer surface 102 and an inner surface 104. It should be understood that the outer surface 102 is configured to be worn facing away from the skin of the user and the inner surface 104 is configured to be worn against the skin of the user. The towel 100 includes a main body portion 106 and a support device 101. As will be discussed in greater detail below, the support device 101 can be secured to the inner surface 104 of the main body portion 106 and extends upward away from the main body portion 106 to form a neck support 108. The towel 100 and/or the support device 101 can be fabricated from a variety of breathable materials, not limited to cotton, bamboo, spandex, microfiber, terry, or the like.

The main body portion 106 can be configured to surround at least a portion of the upper body and waist of the user. As discussed herein and as shown in the Figures, the upper body and waist of the user can include any area between the underarms and knees of the user. In some embodiments, the main body portion 106 can be dimensioned to extend any distance between the underarms and ankles of the user. In some embodiments, the length of the main body portion 106 can be adjustable based on the height of the user. In some embodiments, the main body portion 106 can be in the form of a substantially cylindrical, closed configuration including a top edge 112 and a bottom edge 114, with an open cavity within configured and dimensioned to receive the upper body and waist of the user. The perimeters of the top and bottom edges 112, 114 can be substantially circular in configuration and form openings through which the body of the user can pass for wearing the towel 100.

The top edge 103 of the main body portion 106 can include an elastic band 110 secured to the main body portion 106 (e.g., sewn to the material of the main body portion 106) and extending across a portion of or the entire perimeter of the top edge 112 of the towel 100. The elastic band 110 includes an elastic member positioned therein to maintain tension at the top edge 112 of the towel 100. Thus, the elastic band 110 can be stretched for creating a larger perimeter or opening at the top edge 112 when putting or slipping the towel 100 on, and can at least partially retract to maintain a position of the towel 100 on the user. For example, as can be seen in FIG. 1, the elastic band 110 assists in maintaining the towel 100 above the breasts of the user by maintaining a comfortable pressure around the top edge 112. The elastic band 110 also assists in allowing customization of the towel 100, such that the towel 100 can be worn by users of different sizes.

In some embodiments, the bottom edge 114 of the towel 100 can include an elastic band secured to the main body portion 106 such that a comfortable pressure can be maintained around the perimeter of the bottom edge 114. In some embodiments, the bottom edge 114 of the towel 100 can include one or more vertical slits 103 formed therein. For example, the slits 103 can extend from the bottom edge 114 a partial distance (e.g., approximately two inches, three inches, four inches, five inches, six inches, or the like) in the direction of the top edge 112. In some embodiments, the bottom edge 114 can include a slit 103 formed on either side of and offset from a centerline of the towel 100 (e.g., between the medial and lateral sides of the towel 100) (see, e.g., FIGS. 1 and 5). The position of the slits 103 can be formed such that the slits 103 substantially align with the legs of the user, allowing for partial separation of the main body portion 106 at the slits 103. Thus, a greater amount of flexibility is created at the bottom edge 114 for walking and/or sitting.

The support device 101 can be formed from an elongated strip of material, e.g., fabric, that includes first and second ends 116, 118 on opposing sides. The support device 101 can be incorporated into and/or secured to the main body portion 106 of the towel 100. The support device 101 can provide additional support for the main body portion 106 around the neck of the user, and further forms portions that extend below the breasts of the user to provide support to the breasts and absorb perspiration between the breasts and body of the user.

Each of the first and second ends 116, 118 can be secured (e.g., sewed) to the inner surface 104 of the towel 100 such that the first and second portions of the elongated strip of material wrap around and provide support to the lower surface of each respective breast of the user. For example, the first and second ends 116, 118 can be secured to the inner surface 104 of the towel 100, while the remaining surfaces of the elongated strip of material can be movable relative to the inner surface 104. In particular, each of the first and second ends 116, 118 can extend in a substantially semicircular manner from a point 120 located on respective lateral sides of the towel 100 to a central point 122 at the front and top edge 112 of the inner surface 104 of the towel 100. In some embodiments, the first and second ends 116, 118 can be secured to the main body portion 106 beyond the point 120 located on the lateral side of the towel 100 (e.g., to a point on the rear side of the main body portion 106) to ensure full support to the lower surface of each respective breast of the user. The semicircular configuration of the first and second ends 116, 118 can be customized to provide the most support to the respective breasts of the user. In particular, the support device 101 can protrude from the inner surface 104 of the towel 100 to fit under the respective breasts of the user, thereby providing an upward lifting force to the respective breasts and fitting within the space between the breast and the ribcage of the user to absorb perspiration formed in the space.

The elongated strip of the support device 101 can crisscross at the point 122 at the top edge 112 of the inner surface 104 of the towel 100, and extend beyond the top edge 112 to form a neck support 108. In some embodiments, the support device 101 can be secured to the top edge 112 of the towel at the point 122 by, e.g., sewing, an adhesive, or the like. In some embodiments, the towel 100 can include a securing element 124 (e.g., a strap) attached to the top edge 112 of the inner surface 104 of the towel 100. The securing element 124 can include an opening 125 (e.g., a loop) through which the elongated strips of the supporting device 101 can movably pass. Thus, the securing element 124 can maintain the elongated strips of the supporting device 101 at the point 122, while allowing the length of the neck support 108 to be adjusted. In particular, the elongated strips of the securing element 124 can be pulled upward above the top edge 112 to increase the length of the neck support 108. Similarly, the elongated strips of the supporting device 101 can be pulled downward below the top edge 112 to reduce the length of the neck support 108. Customization of the length of the neck support 108 allows for variation in the height at which the top edge 112 of the towel 100 is positioned relative to the body of the user.

After the crisscross at the point 122, top portions 126 of the support device 101 that form the neck support 108 can extend above the top edge 112 and form a loop 128 above the top edge 112 of the towel 100. The loop 128 can be configured and dimensioned to receive a user's head therethrough. In some embodiments, as noted above, the length or size of the loop 128 can be adjustable based on the requirements of the user by adjusting the position of the top portions 126 relative to the securing element 124.

In some embodiments, the securing device 100 can be in the form of a single elongated strip that creates a continuous loop 128 of the neck support 108. In some embodiments, as shown in FIGS. 5-8, the securing device 100 can be in the form of two elongated strips. The first and second ends 116, 118 of the respective elongated strips can be secured to substantially lateral portions of the inner surface 104 of the towel 100, while the opposing first and second ends 117, 119 include complementary attachment mechanisms 130 (e.g., hook and loop elements) for detachably securing the first and second ends 117, 119 relative to each other. Thus, the first and second ends 117, 119 can be disconnected from each other when the user puts on the towel 100, the first and second ends 117, 119 can be wrapped around the neck of the user, and the attachment mechanism 130 can be used to secure the first and second ends 117, 119 relative to each other and around the neck of the user to form the loop 128. The position of the first and second ends 117, 119 relative to each other can be adjusted with the attachment mechanism 130 such that the tension and/or length of the neck support 108 can be adjusted. The neck support 108 can thereby be customized based on the size of the user.

When the towel 100 is worn by a user, the loop 128 of the neck support 108 can be positioned around the neck, thereby maintaining the towel 100 positioned around the upper body of the user by preventing the towel 100 from sliding downward. As noted above, in some embodiments, the elastic band 110 can further assist in maintaining a position of the towel 100 on the user. The support provided by the neck support 108 can further maintain upward tension on the first and second ends 116, 118 of the support device 101, which, in turn, provides support to the lower portions of the respective breasts of the user. In particular, the portions of the support device 101 protruding from the inner surface 104 of the towel 100 can be positioned below the lower portions of the respective breasts and the ribcage of the user. Tightening the tension of the neck support 108 around the neck simultaneously tightens the tension of the support device 101 under the breasts, providing greater support to the breasts. The position of the support device 101 under the breasts of the user also prevents or absorbs perspiration which forms in the area. In some embodiments, the tension imparted on the first and second ends 116, 118 can at least partially lift the respective breasts slightly to prevent contact between the breasts and the upper body or ribcage of the user, thereby reducing the amount of perspiration formed. The exemplary towel 100 can thereby be securely worn by the user and provides support to the breasts to prevent or reduce collection of perspiration.

Figure 9:
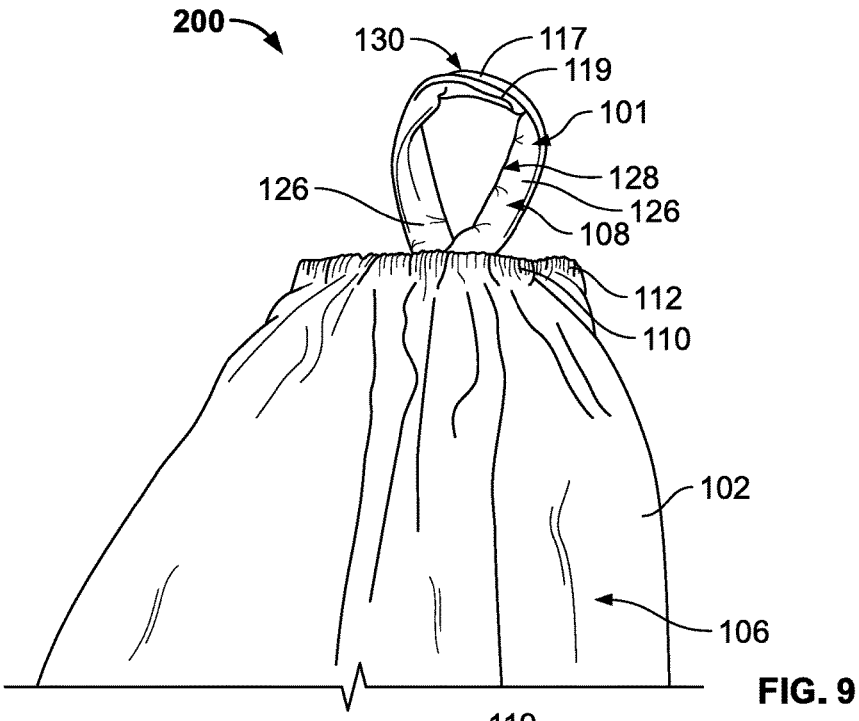
FIG. 9 shows a front view of an exemplary towel including a support device according to the present disclosure.
Figure 10:
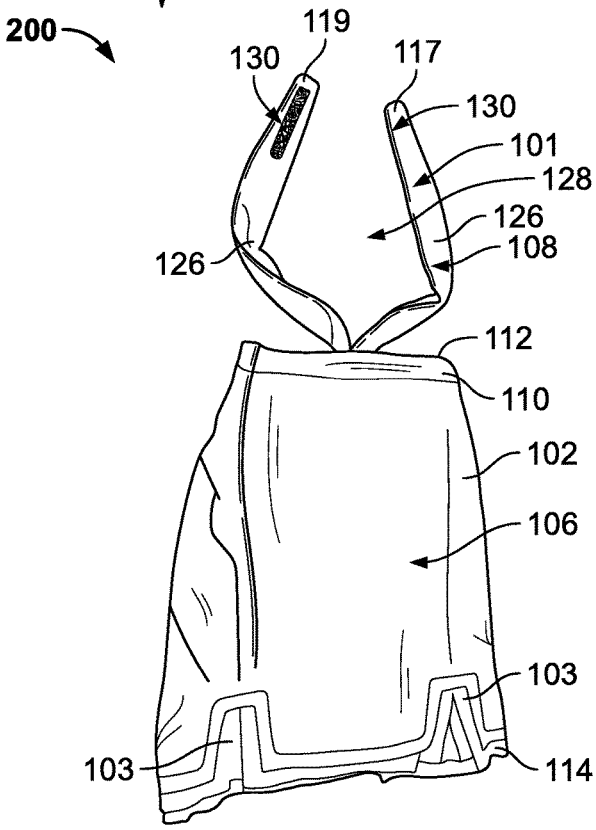
FIG. 10 shows a front view of the exemplary towel of FIG. 9 with a disconnected neck support.
Figure 11:
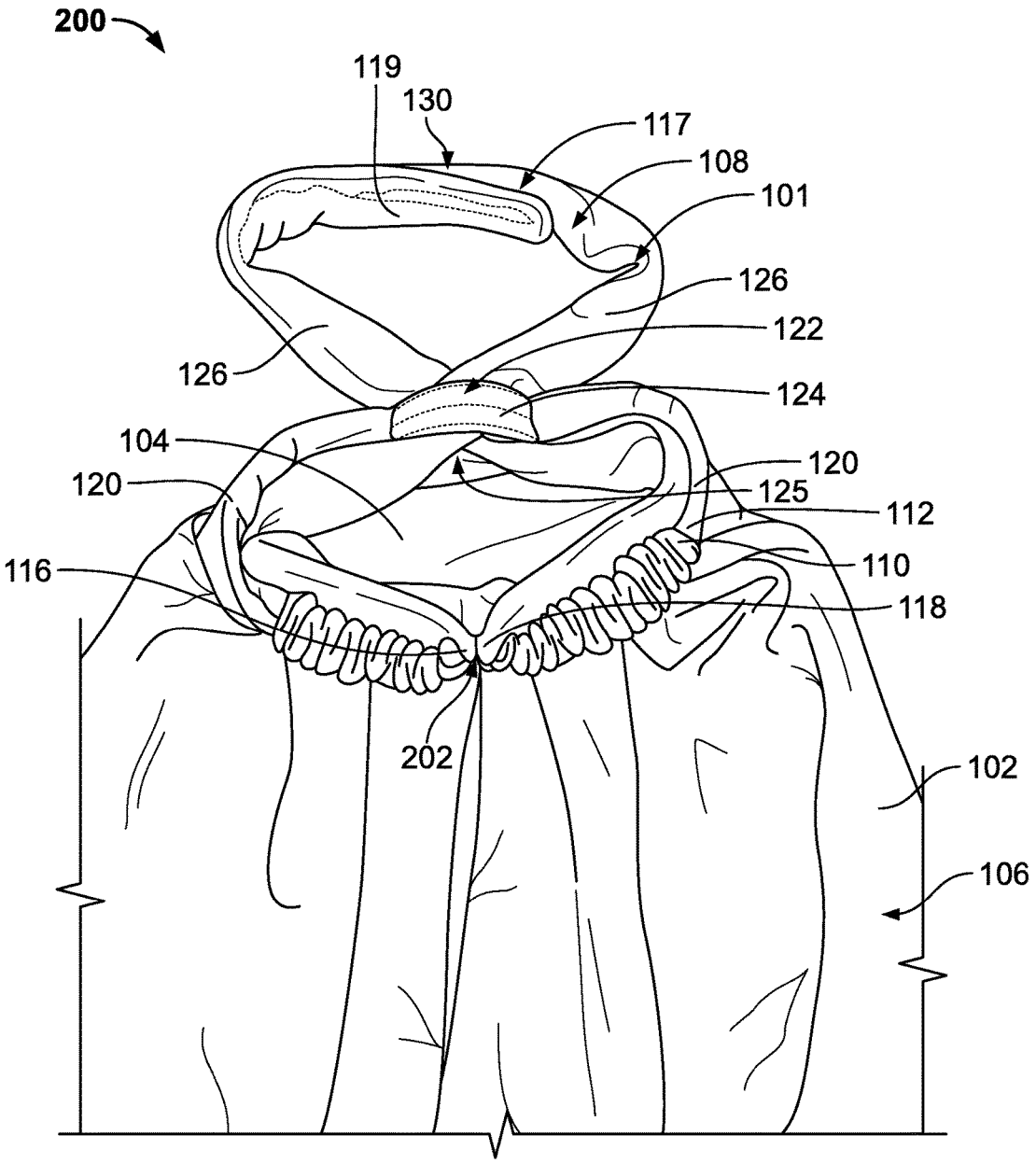
FIG. 11 shows a detailed, top view of the support device of the exemplary towel of FIG. 9.
Figure 12:
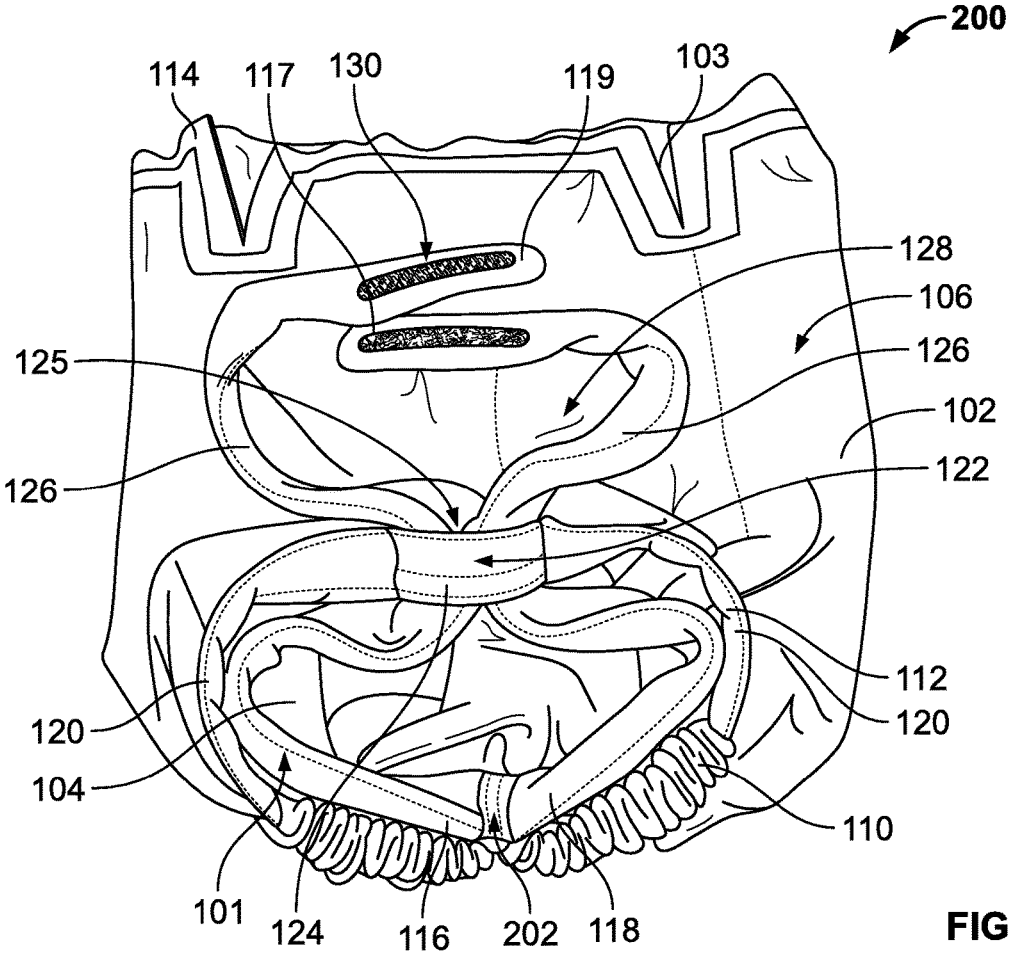
FIG. 12 shows a detailed, top view of the support device of the exemplary towel of FIG. 9.
Figure 13:
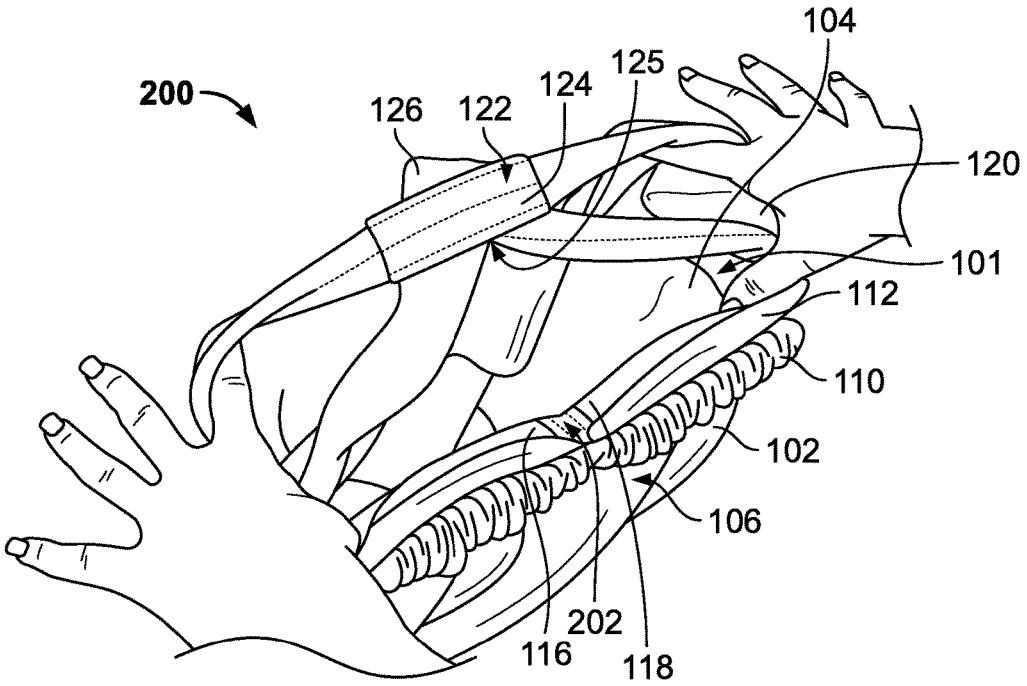
FIG. 13 shows a detailed, top view of the support device of the exemplary towel of FIG. 9.
Figure 14:
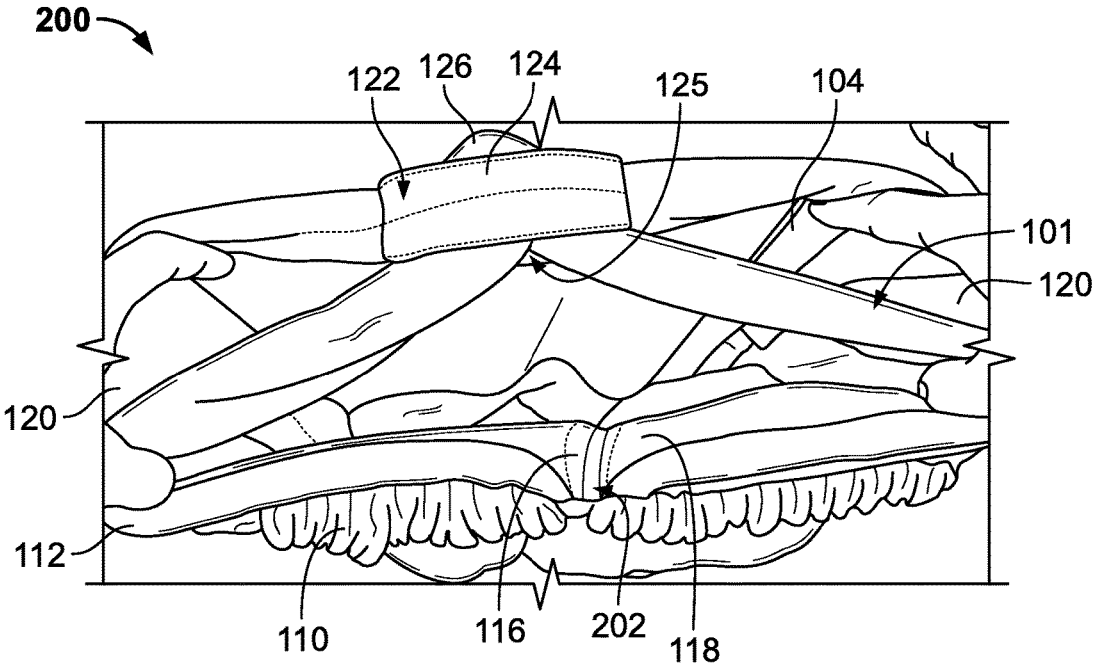
FIG. 14 shows a detailed, top view of the support device of the exemplary towel of FIG. 9.

Turning now to FIGS. 9-14, views of an alternative embodiment of an exemplary towel 200 including a built-in support device 101 are provided. In particular, FIGS. 9 and 10 show front views of the towel 200, and FIGS. 11-14 show detailed view of the support device 101 of the towel 200. The towel 200 can be substantially similar in structure and/or function to the towel 100, except for the distinctions noted herein. Therefore, like reference numbers refer to like structures.

In particular, rather than extending only to the lateral point 120 (or a short distance beyond the lateral point 120), the first and second ends 116, 118 of the support device 101 can extend in a semicircular manner at the front of the main body portion 106, and further extend laterally or semicircularly around the inner surface 104 of the main body portion 106 to a connecting point 202 at the rear of the main body portion 106. For example, the elongated strips of the support device 101 can crisscross at the point 122, extend under the breasts of the user, and further extend to the rear of the towel 100 and connect relative to each other at the connecting point 202. The connecting point 202 can be positioned centrally at the rear of top edge 112 on the inner surface 104. The connection between the first and second ends 116, 118 at the rear of the towel 100 can increase the structural integrity of the support device 101, thereby allowing the desired tension to be imparted below the breasts of the user. In some embodiments, rather than a connection between the first and second ends 116, 118, the first and second ends 116, 118 can be formed as a continuous elongated strip secured at the connecting point 202.

Figure 15:
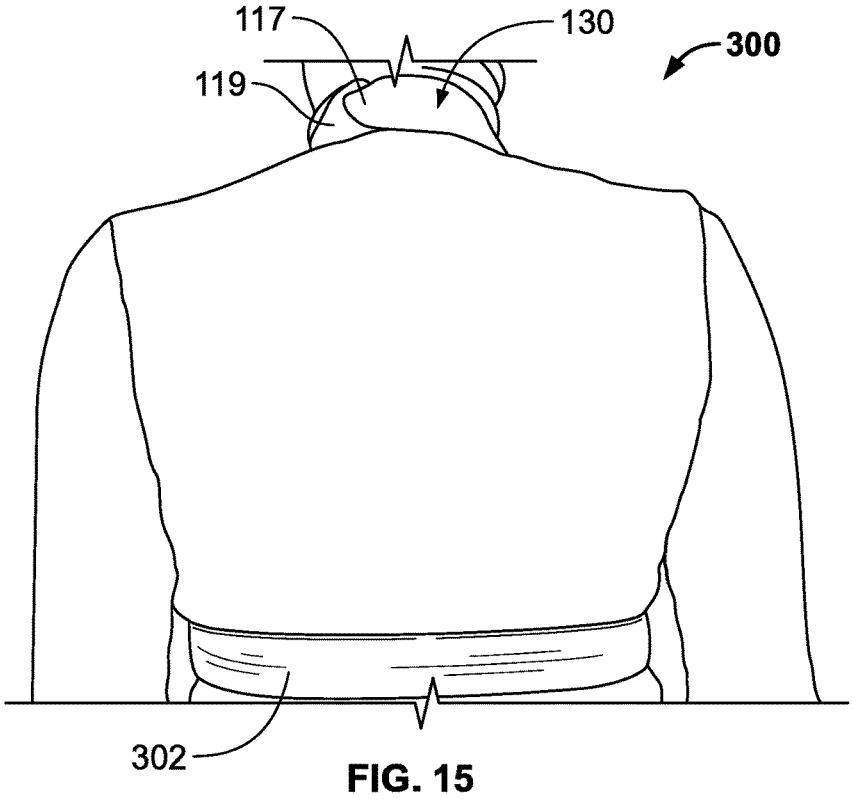
FIG. 15 shows a rear view of an exemplary support device on a user according to the present disclosure.
Figure 16:
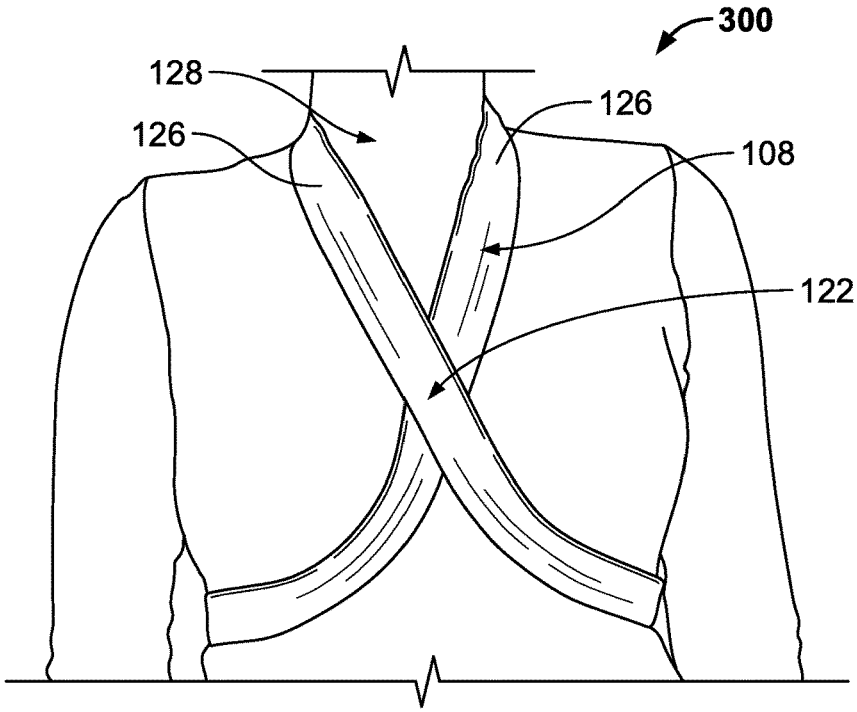
FIG. 16 shows a front view of the exemplary support device on a user of FIG. 15.

Turning now to FIGS. 15 and 16, rear and front views of an exemplary support device 300 are provided, in particular, rather than incorporating, or securing the support device 300 to the inner surface of a towel, in some embodiments, the support device 300 can be used as a separate element to provide support to the breasts of the user and absorb perspiration between the breasts and the body of the user. The support device 300 can be substantially similar in structure and/or function to the support device 101, except for the distinctions noted herein. Therefore, like reference numbers refer to like structures.

As shown in FIGS. 15 and 16, the support device 300 can be formed from a single, elongated strip of material that includes first and second ends 117, 119 on opposing sides of the elongated strip. The first and second ends 117, 119 further include complementary attachment mechanisms 130 incorporated into portions of the first and second ends 117, 119 such that the first and second ends 117, 119 can be detachably secured relative to each other.

During use, a central portion 302 of the support device 300 can be positioned against the middle or top region of the back of the user. The opposing sides of the elongated strip can be wrapped under the respective breasts of the user such that the elongated strips are positioned between the breasts and the body of the user. The elongated strips can further be manually crisscrossed at the point 122 between the breasts of the user. In some embodiments, the crisscross at the point 122 can be maintained via friction between the elongated strips of the support device 300. In some embodiments, the elongated strips can include complementary attachment mechanisms hook and loop mechanisms) at portions offset from the first and second ends 117, 119 such that the crisscross at the point 122 can be maintained. The first and second ends 117, 119 can further be wrapped upward and around the neck of the user to form the neck support 108. The first and second ends 117, 119 can further be secured relative to each other with the attachment mechanisms 130.

The tension of the support device 300 can be adjusted based on a position of the complementary attachment mechanisms 130, allowing for a control in the amount of tension and/or support below the breasts of the user. The support device 300 can therefore provide support to the breasts while absorbing the perspiration formed between the breasts and the body of the user. In some embodiments, a towel or robe can be worn over the support device 300 without affecting the position of the support device 300.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A towel to be worn by a user, comprising:

a main body portion including a top edge, a bottom edge, a front, a back, and a front point located at the front of the main body portion, and a support device secured to the main body portion, the support device including:

one or more elongated strips that include first and second portions configured to wrap underneath breasts of the user, wherein the one or more elongated strips include first and second ends fixedly secured to an inner surface of the main body portion, wherein the first and second portions of the support device remain movable relative to the inner surface of the main body portion and crisscross at the front point of the inner surface of the main body portion, and wherein the one or more elongated strips extend above the top edge of the main body portion to form a neck support configured to wrap around a neck of the user.

2. The towel according to claim 1, wherein the main body portion is configured and dimensioned to cover an upper body and waist of the user.

3. The towel according to claim 1, wherein the top edge includes an elastic band along at least a portion of a perimeter of the top edge.

4. The towel according to claim 1, wherein the one or more elongated strips include a first and second elongated strip, the first elongated strip having the first end fixedly secured to the inner surface of the main body portion, and the second elongated strip having the second end fixedly secured to the inner surface of the main body portion.

5. The towel according to claim 4, wherein the first and second elongated strips each include ends opposing the first and second ends, the ends including complementary attachment mechanisms for detachably securing the ends relative to each other around the neck of the user.

6. The towel according to claim 5, wherein complementary attachment mechanisms allow for adjustment of tension in the neck support.

7. The towel according to claim 1, wherein the first and second portions crisscross at a point at or near the top edge of the main body portion.

8. The towel according to claim 7, comprising a securing element mounted to the inner surface of the top edge of the main body portion, the first and second portions positioned through an opening of the securing element and configured to slide relative to the opening.

9. The towel according to claim 1, wherein the neck support forms a loop configured to be positioned around the neck of the user.

10. The towel according to claim 1, wherein the first and second portions extend to respective lateral points of the main body portion.

11. The towel according to claim 1, wherein the first and second portions extend to a rear side of the main body portion and connect at a central connecting portion at the rear side of the main body portion.

12. A towel to be worn by a user, comprising:

a main body portion including a top edge, a bottom edge, a front, a back, and a front point located at the front of the main body portion, and a support device secured to the main body portion, the support device including an elongated strip that includes first and second portions configured to wrap underneath breasts of the user, wherein the first and second portions of the elongated strip crisscross at the front point of an inner surface of the main body portion, and extend laterally along the inner surface of the main body portion to a connecting point at the back of the main body portion, wherein the elongated strip includes first and second ends fixedly secured to the inner surface of the main body portion at the connecting point, the connecting point disposed on an opposing side of the inner surface of the main body portion relative to the front point, and wherein the elongated strip extends above the top edge of the main body portion to form a neck support configured to wrap around a neck of the user.

13. The towel according to claim 12, wherein the top edge of the main body portion includes an elastic band along at least a portion of a perimeter of the top edge.

14. The towel according to claim 12, wherein the elongated strip includes a first and second elongated strip, the first elongated strip having the first end fixedly secured to the connecting point, and the second elongated strip having the second end fixedly secured to the connecting point.

15. The towel according to claim 14, wherein the first and second elongated strips each include ends opposing the first and second ends, the ends including complementary attachment mechanisms for detachably securing the ends relative to each other around the neck of the user.

16. The towel according to claim 12, wherein the first and second portions crisscross at a point at or near the top edge of the main body portion.

17. The towel according to claim 12, wherein the main body portion is configured and dimensioned to cover an upper body and waist of the user.

* * * * *